US006644334B2

(12) United States Patent
Briggeman

(10) Patent No.: US 6,644,334 B2
(45) Date of Patent: Nov. 11, 2003

(54) METHOD AND SYSTEM FOR REDUCING THE VISCOSITY OF CRUDE OIL EMPLOYING ENGINE EXHAUST GAS

(76) Inventor: William H. Briggeman, 3701 S. 71st West Ave., Tulsa, OK (US) 74107

( * ) Notice: Subject to any disclaimer, the term of this patent is extended or adjusted under 35 U.S.C. 154(b) by 128 days.

(21) Appl. No.: 10/021,145

(22) Filed: Dec. 12, 2001

(65) Prior Publication Data

US 2002/0100500 A1 Aug. 1, 2002

Related U.S. Application Data

(63) Continuation-in-part of application No. 09/567,556, filed on May 5, 2000, now Pat. No. 6,491,053.

(51) Int. Cl.[7] ..... F17D 1/16; F17D 1/17

(52) U.S. Cl. ..... 137/13; 95/245; 95/260; 95/263; 96/202; 96/215; 96/218; 138/42; 138/113; 138/114

(58) Field of Search ..... 137/4, 13, 92, 137/896; 95/39, 241, 245, 260, 263; 96/188, 202, 215, 216, 217, 218; 44/301, 302; 123/3; 138/42, 113, 114; 585/899

(56) References Cited

U.S. PATENT DOCUMENTS

| | | | | |
|---|---|---|---|---|
| 3,006,354 A | | 10/1961 | Sommer | 137/13 |
| 3,040,760 A | | 6/1962 | Macks | 137/13 |
| 3,389,714 A | | 6/1968 | Huges, et al. | 137/13 |
| 3,425,429 A | | 2/1969 | Kane | 137/13 |
| 3,618,624 A | | 11/1971 | Valrogs | 137/13 |
| 3,653,438 A | | 4/1972 | Wagner | 166/266 |
| 3,726,298 A | | 4/1973 | Meritt | 137/13 |
| 3,963,000 A | * | 6/1976 | Kosaka et al. | 123/3 |
| 4,287,902 A | | 9/1981 | McClaflin et al. | 137/13 |
| 4,333,488 A | | 6/1982 | McClaflin | 137/13 |
| 4,340,076 A | | 7/1982 | Weitzen | 137/13 |
| 4,420,008 A | | 12/1983 | Shu | 137/4 |
| 4,576,005 A | * | 3/1986 | Force | 123/3 |
| 5,000,872 A | | 3/1991 | Olah | 252/314 |
| 5,025,863 A | | 6/1991 | Haines et al. | 166/305.1 |
| 5,104,516 A | | 4/1992 | de Bruijn et al. | 208/107 |
| 5,283,001 A | | 2/1994 | Gregoli et al. | 252/314 |
| 5,322,617 A | | 6/1994 | de Bruijn et al. | 208/108 |
| 5,515,814 A | * | 5/1996 | Cooke | 123/3 |
| 5,566,760 A | | 10/1996 | Harris | 166/308 |
| 5,863,301 A | | 1/1999 | Grosso et al. | 44/301 |
| 5,947,063 A | * | 9/1999 | Smith et al. | 123/3 |
| 6,054,496 A | | 4/2000 | Crane et al. | 518/702 |
| 6,079,373 A | * | 6/2000 | Kawamura | 123/3 |
| 6,201,163 B1 | | 3/2001 | Morris et al. | 585/899 |

FOREIGN PATENT DOCUMENTS

| | | | |
|---|---|---|---|
| FR | 2 484 603 | 4/1980 | 137/13 |
| GB | 1235 150 | 6/1971 | 177/261 |
| SU | 752117 | 7/1980 | 137/13 |

* cited by examiner

*Primary Examiner*—George L. Walton
(74) *Attorney, Agent, or Firm*—Gable & Gotwals; Paul H. Johnson

(57) ABSTRACT

A method and system for treating crude oil to improve its flowability includes operating an internal combustion engine to produce exhaust gas, reducing the temperature of the exhaust gas, injecting cooled exhaust gas into a separator in which water is extracted to provide dry exhaust gas, pumping crude oil at an elevated pressure into a treatment vessel, compressing the dry exhaust gas to provide pressurized exhaust gas that is introduced into the treatment vessel and intimately mixing the crude oil and the pressurized exhaust gas in the treatment vessel to provide treated crude oil having a substantial portion of the exhaust gas absorbed therein to thereby provide crude oil having improved flowability.

17 Claims, 3 Drawing Sheets

METHOD AND SYSTEM FOR REDUCING THE VISCOSITY OF CRUDE OIL EMPLOYING ENGINE EXHAUST GAS

REFERENCE TO PENDING APPLICATIONS

This is a continuation-in-part of U.S. patent application Ser. No. 09/567,556 filed May 5, 2000 now U.S. Pat. No. 6,491,053 for A METHOD AND SYSTEM FOR REDUCING THE VISCOSITY OF CRUDE OIL EMPLOYING ENGINE EXHAUST GAS.

REFERENCE TO MICROFICHE APPENDIX

This application is not referenced in any Microfiche Appendix.

FIELD OF THE INVENTION

The invention herein relates to a method and a system to improve the flowability of crude oil at the earth's surface by reducing its viscosity and to thereby augment the movement of crude oil through pipelines and process equipment. The invention herein is intended to achieve the ultimate goal of reducing the problems and expense of moving heavier or more viscous crude oil through pipeline and process equipment.

BACKGROUND OF THE INVENTION

Others have taught the concept of mixing gases with liquids to change the characteristic of the liquids, including the viscosity thereof. More particularly, others have suggested the use of gases mixed with crude oil, particularly in subterranean locations, to augment production of crude oil. As an example, U.S. Pat. No. 5,025,863 entitled, "Enhanced Liquid Hydrocarbon Recovery Process" teaches the use of natural gas injected into an oil bearing formation to render the liquid hydrocarbons mobile and thereafter the mobilized liquid hydrocarbons are more easily produced from the well.

In U.S. Pat. No. 5,104,516 entitled, "Upgrading Oil Emulsions With Carbon Monoxide or Synthetic Gas" involves contacting a water emulsion of a heavy oil with carbon monoxide at a temperature range such that a water gas shift reaction takes place to thereby assist in reducing the viscosity of the crude oil.

French Patent No. 2,484,603 by Charles Brandon et al. teaches that the viscosity of heavy oils is reduced by dissolving $CO_2$ in the oil in the amount of 20–120 $Nm^3/m^3$ and the process facilitates pipeline transportation of the oil. This patent teaches that the $CO_2$ can be generated by burning a portion of the oil or the heavy residue from a preflash unit. This patent does not teach the use of exhaust gas from an internal combustion unit in a system and method of improving the flowability of crude oil.

For other background information relating to the general subject matter of the invention herein reference may be had to the following United States patents:

| U.S. PAT. NO. | INVENTOR | TITLE |
|---|---|---|
| 3,006,354 | Sommer et al. | Method for Transporting Liquids Through Pipelines |
| 3,040,760 | Macks | Conduit |
| 3,425,429 | Kane | Method of Moving Viscous Crude Oil Through a Pipeline |
| 3,653,438 | Wagner | Method for Recovery of Petroleum Deposits |

-continued

| U.S. PAT. NO. | INVENTOR | TITLE |
|---|---|---|
| 3,726,298 | Meritt | Pressure Control for Flare Systems |
| 4,287,902 | McClaflin et al. | Method of Transporting Viscous Hydrocarbons |
| 4,333,488 | McClaflin | Method of Transporting Viscous Hydrocarbons |
| 4,340,076 | Weitzen | Dissolving Polymers in Compatible Liquids and Uses Thereof |
| 4,420,008 | Shu | Method for Transporting Viscous Crude Oils |
| 5,000,872 | Olah | Surfactant Requirements for the Low-Shear Formation of Water Continuous Emulsions from Heavy Crude Oil |
| 5,025,863 | Haines et al. | Enhanced Liquid Hydrocarbon Recovery Process |
| 5,104,516 | de Bruijn et al. | Upgrading Oil Emulsions with Carbon Monoxide or Synthesis Gas |
| 5,283,001 | Gregoli et al. | Process for Preparing a Water Continuous Emulsion from Heavy Crude Fraction |
| 5,322,617 | de Bruijn et al. | Upgrading Oil Emulsions with Carbon Monoxide or Synthesis Gas |
| 5,566,760 | Harris | Method of Using a Foamed Fracturing Fluid |
| 5,863,301 | Grosso et al. | Method of Produce Low Viscosity Stable Crude Oil Emulsion |
| 6,054,496 | Crane et al. | Method for Transporting a Heavy Crude Oil Produced Via a Wellbore from a Subterranean Formation to a Market Location and Converting it into a Distillate Product Stream Using a Solvent Deasphalting Process |
| 6,201,163 | Morris et al. | Pipeline Transmission Method |

BRIEF SUMMARY OF THE INVENTION

Crude oil, particularly that produced from certain geological formations, can be relatively viscid, that is, can have a viscosity that makes it difficult to transfer through a pipeline. Heavy, thick viscid crude oil is referred to in the petroleum industry as "low gravity" oil; high gravity crude oil being that which is relatively thin and relatively easy to pump.

The viscosity of crude oil is affected by temperature and one way to decrease the viscosity of crude oil is to increase the temperature. While increasing temperature is a common way to reduce viscosity it is an expensive procedure and is not an acceptable procedure for improving the viscosity of crude oil that must be transmitted over a relatively long distance pipeline since maintaining an elevated temperature of crude oil in a pipeline is extremely difficult.

Another way of decreasing the viscosity of crude oil is to mix with it an immiscible high gravity liquid component. For instance, gasoline, kerosene or other high gravity components can be mixed with viscid crude oil to reduce the viscosity so that it can be more effectively pumped. At the destination, the added gasoline, kerosene or so forth can be removed and recycled. This procedure works effectively to reduce the viscosity of crude oil but is expensive and in many applications impractical, particularly where crude oil must be pumped over a relatively long distance so that thereby recirculating the thinning agent becomes a serious problem.

Viscosity is the degree to which a fluid resists flow under an applied force. Viscosity is measured by the tangential stress on the fluid divided by the resultant viscosity gradient under conditions of streamlined flow. The unit of measurement of viscosity is "poise". Poise is a centimeter-gram-second unit of dynamic viscosity equal to one dyne-second per square centimeter. Viscosity is usually expressed in 1/100th of a poise, that is, in centipoise. In the petroleum industry the pumpability of crude oil is usually characterized by its gravity. High gravity crude oil is thin and easily pumpable. Low gravity crude oil is thick and difficult to pump. High gravity equates to low viscosity and high viscosity to low gravity.

The present invention is concerned with a method of decreasing the viscosity of crude oil in a manner that does not require elevating its temperature or the use of a high gravity liquid thinning component. The present invention achieves reduced viscosity of crude oil by injecting into the crude oil, under high pressure, a gas, or a combination of gases. Particularly the invention is concerned with injecting into crude oil carbon dioxide ($CO_2$) or more preferably, a combination of $CO_2$ and nitrogen (N).

In a system for practicing the invention, $CO_2$ is thoroughly admixed with crude oil at an elevated pressure. Instead of $CO_2$ only, a mixture of $CO_2$ and N may be employed in ratios ranging from 8% N, 92% $CO_2$ to 92% N, 8% $CO_2$. The $CO_2$, or mixture of $CO_2$ and N, is thoroughly admixed with crude oil at a pressure of at least about 600 lbs per square inch (psi). A preferred pressure for admixing crude oil and gas to achieve decreased viscosity is from about 600 psi to 1800 psi although the maximum upper pressure is limited only by the availability of equipment and the expense of attaining the higher pressure.

In practicing the invention the crude oil is introduced into a mixer that may be in the form of an elongated horizontal cylindrical treating vessel having within it a reduced diameter centralized gas injection pipe, the pipe having a plurality of spaced apart small diameter openings therein. A spiraled, auger-shaped fin is affixed to the gas injection pipe to cause the crude oil flowing through the treating vessel to take a circuitous route and to thereby cause a more thorough admixing of injected gas and crude oil.

The quantity of gas employed is determined by the viscosity reduction required. For maximum viscosity reduction the maximum gas the crude oil will absorb is used. Stated another way, the reduction in viscosity is most effectively and efficiently obtained by employing gas the rate at which, for the treating pressure level, all of the gas is absorbed by the crude oil.

Experience has indicated that crude oil, having been treated to cause the absorption of $CO_2$ or a combination of $CO_2$ and N, at elevated pressures, attains a reduced viscosity that is relatively long lasting. When the treated oil is exposed to ambient pressure the dissolved gas eventually separates out of solution and the crude oil will eventually revert to its natural viscosity, however, the rate of separation is not instantaneous when pressure reduction occurs but is a relatively slow process so that crude oil, after having the viscosity reduced by the methods of this invention can be pumped efficiently over relatively long distances.

In a preferred embodiment of the invention, a method is provided of treating crude oil to improve its flowability including the steps of operating an internal combustion engine to produce exhaust gas. The temperature of the exhaust gas is reduced to provide cool exhaust gas which is injected into a separator in which water is extracted to provide dry exhaust gas. Water is withdrawn from the separator. The crude oil is pumped at a preselected elevated pressure into a treatment vessel. The dry exhaust gas is compressed to a preselected pressure that is equal to and preferably greater than the pressure of the crude oil, to provide pressurized exhaust gas. In a treatment vessel, the crude oil and exhaust gas at an elevated pressure are intimately mixed. Provided treated crude oil. The output of treated crude oil from the pressure vessel is fed to a separator wherein excess gas is removed to provide a treated crude oil having improved flowability.

The dry exhaust gas that is mixed with crude oil under pressure conditions is composed essentially of N and $CO_2$ in the ratio of about 80 to 90% N and 10 to 20% $CO_2$ by weight. This ratio is typical of exhaust gas produced by an internal combustion engine.

In a preferred method of operating the system of this invention, the engine that produces a source of exhaust gas also provides motive power that is employed to move a fan in a cooler to cool the exhaust gas and/or to operate a compressor to compress the exhaust gas for injection into a treating vessel. Depending upon the size of the internal combustion engine and other factors, the internal combustion can, in some applications, be also used to drive a high pressure pump for pumping the crude oil up to the pressure requirement for the mixing step.

Gasified crude oil appearing at the outlet of the treatment vessel is passed to a separator wherein any excess gas—that is, gas that is not absorbed in the treated crude oil, can be separated before the treated crude oil is passed into a pipeline or to process equipment.

DESCRIPTION OF THE DRAWINGS

FIG. 2 illustrates one means of improving the absorption of injected gases.

DETAILED DESCRIPTION OF A PREFERRED EMBODIMENT

This invention is a process and apparatus for improving the flowability of crude oil by decreasing the viscosity of the crude oil in a nondestructive manner. Increasing flowability decreases the horsepower required to transport crude oil in a pipeline over a long distance, especially if the crude oil is innately viscous—that is, of low gravity.

The invention employs the use of a mixing chamber for mixing low gravity crude oil by the injection of a gas or gases under pressure to create a high gravity oil which will remain in this state as it is pumped through a pipeline. Tests have indicated that at treating pressures between 600 psi and 1800 psi, injecting a gas solution of $CO_2$ and N into low gravity crude oil and then flowing this mixture through a fluid velocity changing device that a miscible solution of high gravity crude oil is achieved and the characteristics of this improved gravity crude oil do not change markedly as pressure-drop points are encountered. The mixture of $CO_2$ and N can be varied with $CO_2$ ranging from 8% to 92% by volume and N ranging from 8% to 92% by volume. The reduction in gravity will vary in proportion to the quantity of $CO_2$ or $CO_2$ plus N injected into the crude oil.

The gas agent can be varied from a composition of 8% $CO_2$ and 92% N to 100% $CO_2$ and 0% N. The effect of viscosity reduction varies with the mixture of $CO_2$ and N and the composition of the oil being treated. The optimum ratio of $CO_2$ and N is dependant somewhat upon the cost and availability of these gases taken into consideration with the reduced cost of pumping high gravity oil.

In a preferred embodiment of the method and system of this invention a gas for use in reducing crude oil viscosity is obtained from hydrocarbon fuel consuming apparatus, such as an internal combustion engine.

Figure 1:
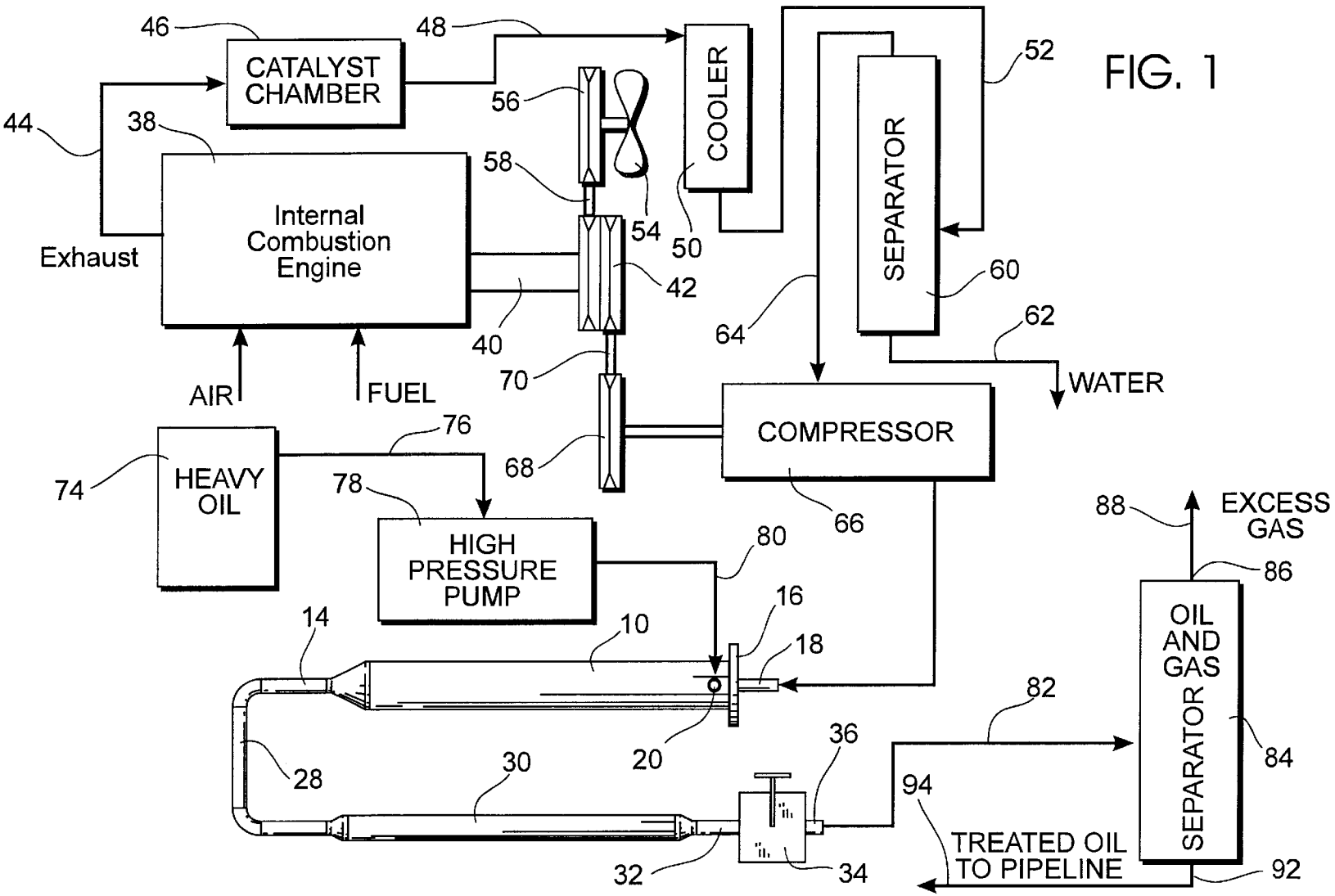
FIG. 1 is a plane view of a system for practicing the methods of this invention. The system includes a treating vessel into which crude oil and $CO_2$ or $CO_2$ plus N are injected. The system includes a stabilization vessel and a discharge conduit by which the treated reduced viscosity crude oil may be conveyed to a pipeline or to other process equipment.

Referring to the drawings, FIG. 1 shows the basic components required for practicing the invention. An elongated cylindrical horizontal treating vessel as indicated by the numeral 10. Vessel 10 has an inlet end 12 and an outlet end 14. At the inlet end 12 a flange 16 receives a gas injection pipe 18. In the cylindrical walls of vessel adjacent inlet end 12 is an oil inlet 20.

Figure 2:
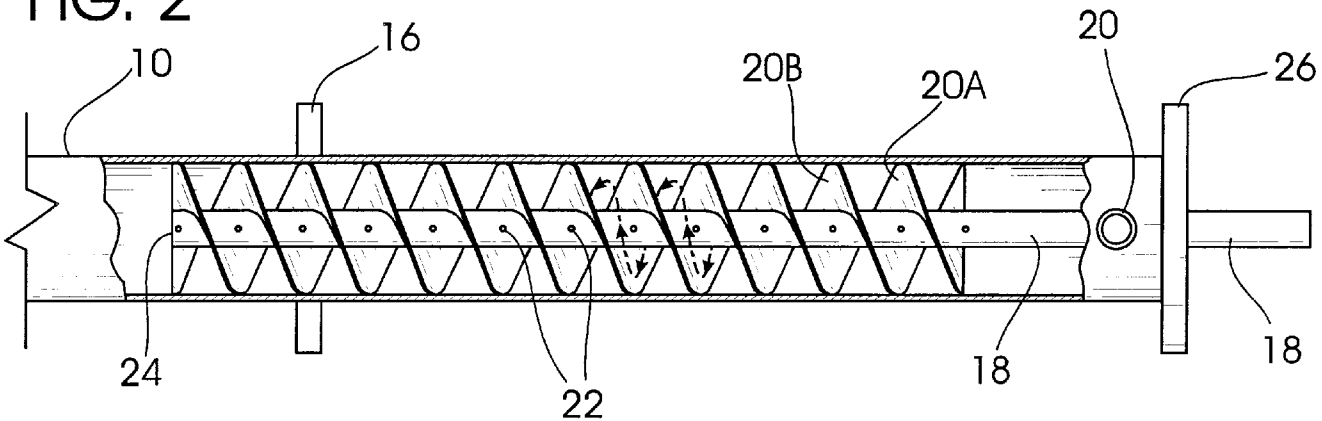
FIG. 2 is an enlarged elevational view of a gas injector pipe having a spiral fin thereon as employed within the treating vessel of FIG. 1.

FIG. 2 shows an interior component of the treatment vessel 10. Gas injection pipe 18 is centrally positioned within vessel and has affixed to its exterior surface a spiraled fin. In the illustrated arrangement there are twin spiral fins 20A and 20B although a single spiral fin would achieve the same results. Gas pipe 18 has spaced apart small diameter gas outlet openings 22, the openings being intermediate spiral fins 20A and 20B. The distal end of gas pipe 18 is closed although the closed end could have a small diameter gas outlet opening therein. An attachment flange 26 is secured to gas injection pipe 18 to mate with vessel flange 16 by which the injection with its spiral fin is maintained within the assembly. In the treatment process, low gravity, that is, viscid crude oil is injected through oil endlet 20 at high pressure, such as a minimum of about 600 psi. Simultaneously gas is injected under the same or a greater pressure through gas pipe 18.

Gas is ejected through spaced small diameter openings 22 and thoroughly admixed with the crude oil as it flows through the vessel. The gas is absorbed by the low gravity crude oil. Sufficient gas is employed to attain the amount of reduction of viscosity that is required by the process. That is, if the crude oil injected through oil inlet 20 is only marginally too viscid for transportation a relatively smaller amount of gas needs to be injected to raise the gravity as required however, if the crude oil is very viscid then larger amounts of gas are required. The maximum amount of gas to be used is that which will be absorbed within the crude oil. That is, the system is not predicated upon creating a dual phase mixture in which the crude oil is less viscid because of entrained bubbles of gas but the system is predicated upon mixing gas within the oil under conditions so that the gas is absorbed and the output of the mixture at vessel outlet 14 is essentially a single phase crude oil liquid with absorbed gas.

The process must be conducted at high pressures. The pressure within vessel must be a minimum of at least about 600 psi and the pressure can increase up to about 1800 psi or higher. The pressure used in the method is that which is required to cause the absorption of sufficient gas to obtain the required viscosity reduction.

The crude oil that flows out outlet end 14 of vessel passes into a conduit 28 and then into an entrainment vessel 30 that has an increased cross-sectional area. The velocity of flow of the treated crude oil within the larger diameter entrainment vessel 30 is reduced, serving to increase the absorption of gas by the crude oil. A conduit 32 at outlet end of entrainment vessel 30 passes the treated crude oil through a choke 34 to an outlet pipe 36 that can connect with a pipeline or other processing equipment.

Figure 3:
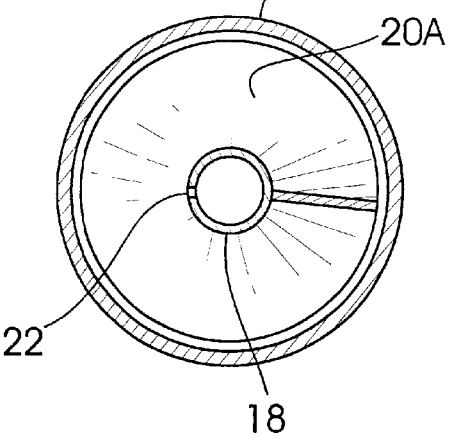
FIG. 3 is a cross-sectional view taken along the line 3—3 of FIG. 1 showing the gas injection pipe centrally positioned within the treating vessel with a spiral fin extending around the injection pipe.

The system as illustrated in FIGS. 1–3 is an example of one way of thoroughly admixing an injected gas into low gravity crude oil to reduce its viscosity. The illustrated system does not employ moving parts to achieve mixing although the use of mixers with moving parts may also be advantageous in some applications. The essence of the system as illustrated in FIGS. 1–3 is that which achieves thorough admixing of gas and oil so that all or at least substantially all of the gas is absorbed by the crude oil to provide a single phase fluid flow of reduced viscosity crude oil that can be more efficiently pumped or otherwise used in processing systems.

The expression "gas" as used herein means $CO_2$ or a mixture of $CO_2$ and N or the exhaust gas from a hydrocarbon fuel consuming apparatus, such as an internal combustion engine.

Successful testing of the system of FIGS. 1–3 has involved processing heavy oil that is best described as "tank bottoms", in the range of 15 to 22 gravity oil. Tests were conducted on crude oil using pressures from 600 psi to 1800 psi. Measured gravity at the discharge point of the equipment that is, in conduit 32 in the arrangement of FIG. 1, at 800 psi was 35.5; at 900 psi, 38.5; and at 1000 psi, 41+ gravity, that is higher than the available measuring device. These tests therefore indicate that the increase in gravity, that is, the reduction in viscosity, is proportional to the pressure under which the gas is admixed with the crude oil. In addition, the higher the pressure the greater the quantity of gas that can be absorbed by the crude oil.

In this test the treated crude oil, that is crude oil with absorbed $CO_2$ or $CO_2$ plus N, at an elevated pressure was then exposed to the atmosphere. When exposed to the atmosphere there was no visual indication of an immediate boiling off or flashing off of the gas from the treated crude oil however, it is understood that over time when the treated crude oil is subjected to ambient pressures that the absorbed gas will eventually be dissipated in which case the crude oil will return to its natural viscosity. An essential discovery resulting from this invention is that crude oil thoroughly admixed with $CO_2$, or $CO_2$ plus N, at elevated pressures, experiences a significant increase in gravity and the improved gravity characteristic subsists for a significant time after elevated pressures are removed to permit the treated crude oil to be more efficiently pumped through a pipeline.

The invention as described herein and particularly the apparatus shown in FIGS. 1–3 is exemplary of one system for practicing the methods of this invention. At the time of preparation of this disclosure additional research is ongoing and it is apparent that additional testing will result in a better understanding of the invention so that the ratios of gases and pressure required to achieve targeted reductions in viscosity of crude oil can be more accurately predicted. In addition, the advantageous employment of relative ratios of $CO_2$ and N will be more particularly defined by additional experimentation.

Figure 4:
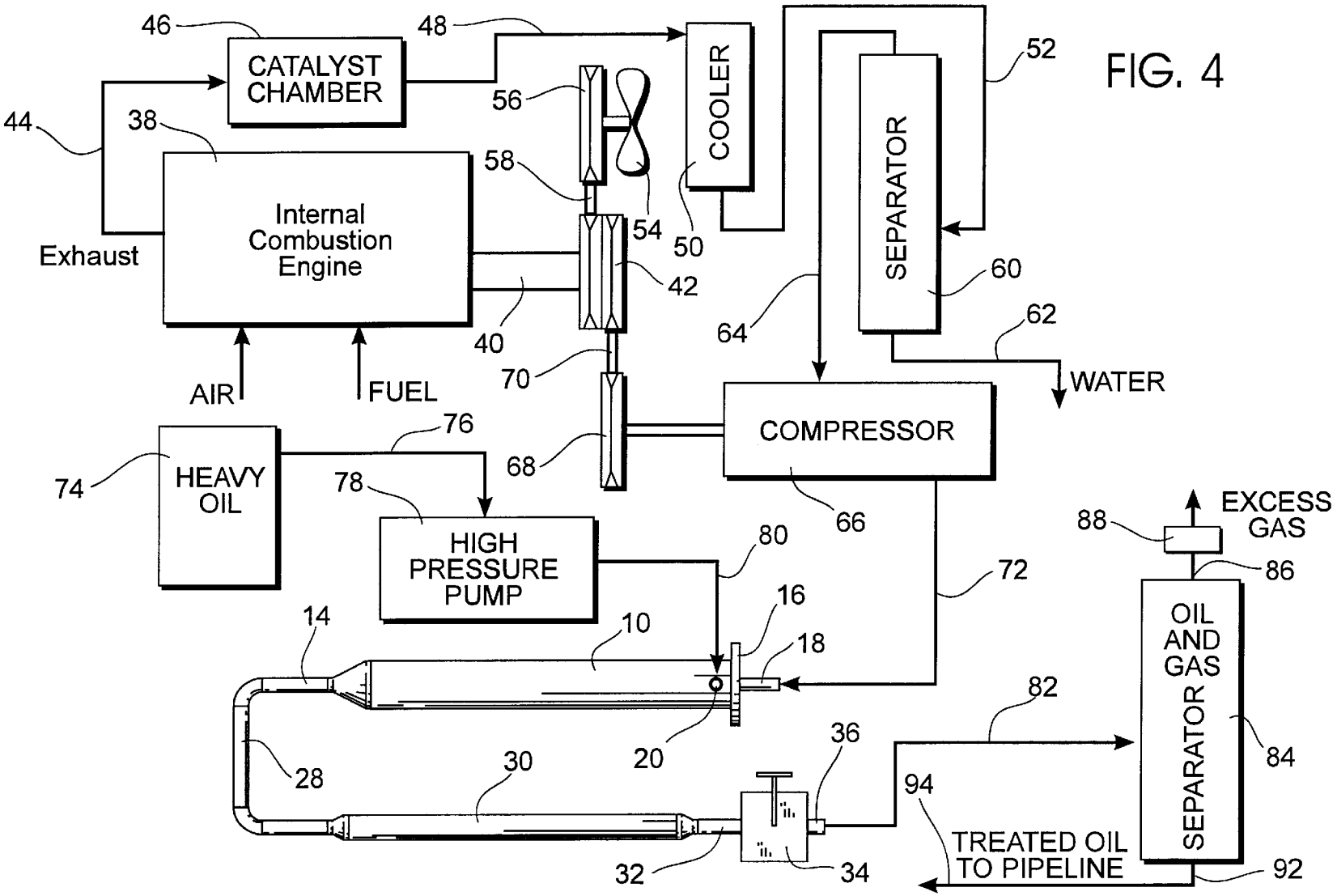
FIG. 4 is a diagram of a system for employing exhaust gas from an internal combustion engine in a method for increasing the flowability of crude oil.

FIG. 4 illustrates diagrammatically a method and a system of this invention for treating crude oil to improve its flowability—that is, specifically, to increase its viscosity. An internal combustion engine is diagrammatically illustrated by block 38. Engine 38, as is characteristic of internal combustion engines, employs fuel which is traditionally hydrocarbon fuel, such as gasoline, diesel, propane, butane and so forth. The combustion of the fuel mixed with air within the engine drives pistons which turn a crank shaft 40 to provide motive power to a drive pulley 42. Engine 38 produces exhaust gas through an exhaust 44. This invention is concerned with the use of gasses 44 passing from engine exhaust to improving the flowability of crude oil.

Exhaust gas from exhaust 44 passes through a chamber 46 wherein heated catalyst reacts with deleterious components of the combustion process to degrade these components so that they are more environmentally acceptable. Catalytic chambers, usually called catalytic converters, are commonly employed on automobiles and trucks. From catalyst chamber 46 the exhaust gas passes by way of conduit 48 to the input of a cooler 50 which, as illustrated and in the preferred embodiment, is an air cooler. That is, cooler 50 functions by exchanging the heat of exhaust gases passing through conduit 48 with ambient air to cool the exhaust gases that passes out of cooler 50 through a conduit 52. Cooler 50 typically requires forced movement of ambient air through it and this is achieved by a fan 54 which can be driven by a sprocket 56 rotatably coupled to drive pulley 52 by a flexible belt 58. This technique makes use of the motive power produced by engine 38, however, is not indispensable in practicing the invention as an auxiliary source of power could be employed to drive fan 54, such as an electric motor.

The cooled exhaust gas flowing through conduit 52 enters a separator 60. Separator 60 is typically of the type commonly employed in the petroleum and chemical industry that is a vessel in which any water, including water condensed from vapor contained within the cooled exhaust gas can settled to the bottom. Water extracted from the exhaust gas is removed from separator 60 by a water outlet 62. Dried exhaust gas passes out of separator 60 through an outlet conduit 64 into the intake of gas compressor 66. Compressor 66 may be driven by any energy source, however, in a preferred arrangement it has a drive sprocket 68 connected by a belt 70 to drive pulley 42. In this way energy required to operate compressor 66, along with air cooler 50 is supplied from motive power available from internal combustion engine 38. However, as stated with reference to cooler 50, a separate source of energy may be employed to drive compressor 66.

Compressor 66 increases the pressure of the dried exhaust gas to an elevated level. As has been described with reference FIGS. 1–3, the pressure of gas appearing at the compressor outlet 72 is preferably at least 600 psi and further, is preferably in the range of about 600 psi to about 1800 psi. The compressed dried exhaust gas appearing at compressor outlet 72 is utilized in the system and employing the method as been described with reference to FIGS. 1 to 3 to increase the viscosity of crude oil. Accordingly, the compressed dried gas from compressor 66 is fed to gas injection pipe 18 communicating with treatment vessel 10.

A diagrammatic block 74 is representative of a tank or other source of crude oil is to be pumped through a pipeline. The source of crude oil 74 may be from a gathering line in an oil field or crude oil delivered by a tanker. If heavy crude oil flows for a distance through a relatively large diameter pipeline the principles of this invention may be employed to take the heavy crude oil from a pipeline and treat it so that the same volume of crude oil may be pumped through a small diameter pipeline to its ultimate destination, such as a refinery or other processing station. Crude oil 74 is, as has previously been stated, typically referred to as "heavy" or "low gravity" crude oil that has a viscosity at ambient temperatures that makes it difficult to efficiently move through a pipeline. Such heavy crude oil from source 74 is fed by conduit 76 to the input of a high pressure pump 78. Here the crude oil is elevated in pressure to at least match that of approximately compressed gas in conduit 72, the crude oil being injected into oil inlet 20 of treating vessel 10. As with the compressed gas, the pressure of crude oil in the outlet 80 from pump 78 is preferably at least about 600 psi and also preferably in the range of about 600 to about 1800 psi. Thus, treatment vessel receives the injection under high pressure of crude oil and compressed dried exhaust gas.

In treatment vessel the crude oil and exhaust gas are intimately mixed in the manner that has been described above with reference to FIGS. 1–3. The intimately mixed crude oil and exhaust gas exits outlet and 14 of treatment vessel and flows by way of conduit 28 into an entrainment vessel 30. Outlet conduit 32 is connected with a choke 34 to maintain back pressure on the mixed crude oil and exhaust gas to ensure the absorption of a substantial portion of the exhaust gas by the crude oil. The crude oil having exhaust gas absorbed therein passes through choke 34 and to outlet pipe 36 that connects to the inlet 82 of an oil/gas separator 84. In separator 84 excess gas, that is, gas that has not been absorbed by the crude oil, is separated from the crude oil and passes out of the separator through gas outlet 86. A choke 88 connected to gas outlet 86 maintains back pressure within oil/gas separator 84. The outlet 90 from choke 88 conducts excess gas for disposition such as to the atmosphere.

Treated crude oil flows out oil/gas separator 84 through oil outlet 92 and by way of a conduit 94 to a pipeline (not shown) for transportation to a remote location.

Treated crude oil flowing through conduit 94 has reduced viscosity, that is it has improved flowablilty so that it passes more freely through a pipeline. Additional pressure may be applied to the crude oil flowing through conduit 94 by means of a pump. Typically, pumps are spaced at locations along the length of a pipeline to maintain pressure sufficient to achieve required flow rates. By improving the flowability of crude oil, the amount of pumping required to move a predetermined quantity of crude oil through a given size and length of pipeline can be substantially reduced.

As has been explained with reference to FIGS. 1–3, the viscosity of crude oil is increased by co-mingling, under high pressure, crude oil and inert gas that consists essentially of $CO_2$ or $CO_2$ combined with nitrogen. The exhaust of an internal combustion engine is a good source of a gas that is substantially made up of $CO_2$ and nitrogen. The typical exhaust from an internal combustion engine is about 10 to 20% $CO_2$ and about 80 to 90% nitrogen. By drying the exhaust gas as it is passed through cooler 50 all substantial oxygen and/or water containing components are removed in separator 60 so that dry, compressed exhaust gas at the compression outlet 72 is substantially inert so that it will not deleteriously affect a pipeline or other process equipment through which it flows or with which it comes into contact.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A method of treating crude oil to improve its flowability, comprising:

(a) operating an internal combustion engine to produce exhaust gas;

(b) reducing the temperature of the exhaust gas from said engine to provide cooled exhaust gas;

(c) extracting any entrained water from the cooled exhaust gas to provide dry exhaust gas;

(d) pumping said crude oil at a preselected elevated pressure into a treatment vessel;

(e) compressing said dry exhaust gas to a preselected pressure to provide pressurized exhaust gas; and (f) intimately mixing said crude oil and pressurized exhaust gas under a preselected elevated pressure in said treatment vessel to provide treated crude oil having improved flowability.

2. A method of treating crude oil to increase its flowability in a pipeline according to claim 1 including, after step (f) of removing excess gas from said treated crude oil.

3. A method of treating crude oil to increase its flowability in a pipeline according to claim 2 wherein said step of removing excess gas from said treated crude oil include passing said treated crude oil into a separator vessel having a treated crude oil outlet and an excess gas outlet.

4. A method of treating crude oil to increase its flowability according to claim 1 including, after step (a) of passing said exhaust gas from said internal combustion engine through a catalytic chamber wherein catalysts react with deleterious components of said exhaust gas to at least partially neutralize the deleterious components before passing said exhaust gas to step (b).

5. A method of treating crude oil to increase its flowability according to claim 1 wherein said internal combustion engine produces motive energy and in which step (b) includes passing said exhaust gas through a cooler having a fan driven by said internal combustion engine motive energy.

6. A method of treating crude oil to increase its flowability in a pipeline according to claim 1 wherein said internal combustion engine produces motive energy and in which step (e) includes compressing said dry exhaust gas in a compressor driven at least in part by said internal combustion engine motive energy.

7. A method of treating crude oil to increase its flowability in a pipeline according to claim 1 wherein said internal combustion engine produces motive energy and in which step (b) includes passing said exhaust gas through a cooler having a fan driven by said internal combustion engine motive energy and step (e) includes compressing said dry exhaust gas in a compressor driven by said internal combustion engine motive energy.

8. A method of treating crude oil to increase its flowability in a pipeline according to claim 1 wherein step (f) is carried out at an elevated pressure of at least about 600 psi.

9. A method of treating crude oil to increase its flowability in a pipeline according to claim 1 wherein step (f) is carried out at an elevated pressure in the range of about 600 psi to about 1800 psi.

10. A method of treating crude oil to increase its flowability according to claim 1 in which the quantity of dry exhaust gas is sufficiently great to improve the flowability of said crude oil to that required and is not substantially greater than the quantity of said dry exhaust gas that said crude oil will absorb at said preselected elevated pressure in said treatment vessel.

11. A method of treating crude oil to increase its flowability according to claim 1 in which step (f) is carried out in an elongated horizontal cylindrical pressurized treating vessel having within it a reduced diameter centralized gas injection pipe, into which said pressurized exhaust gas is injected, the gas injection pipe having a plurality of spaced apart small diameter openings therein and having an auger-shaped fin affixed to the exterior of the gas injection pipe to cause said crude oil flowing through said treating vessel to take a circuitous route.

12. A system for treating crude oil to improve its flowability, comprising:

a hydrocarbon fuel consuming apparatus producing exhaust gas;

an elongated pressurized treating vessel having a crude oil inlet and a gasified crude oil outlet;

a reduced diameter centralized injection pipe positioned within said treating vessel connected to receive said exhaust gas and having a plurality of spaced apart small diameter outlet openings therein; and an auger-shaped fine supported on an exterior surface of said injection pipe, crude oil flowing under pressure into said treating vessel through said crude oil inlet passing in a circuitous route as channeled by said fin past said plurality of small diameter openings in said injection pipe whereby exhaust gas injected under pressure into said injection pipe is intemently mixed with said crude oil within said treating vessel to form gasified crude oil that is discharged through said gasified crude oil outlet.

13. A system treating crude oil to improve its flowability according to claim 12 including:

an entrainment vessel having an inlet opening and an outlet opening, the inlet opening being connected by a conduit with said treating vessel gasified crude oil outlet, the entrainment vessel having a flow path therethrough having a cross-sectional area greater than a flow path through said conduit whereby the velocity of flow of gasified crude oil is reduced as said crude oil passes through the entrainment vessel to thereby augment absorption of gas by said gasified crude oil passing therethrough, gasified crude oil having increased exhaust gas absorbed therein passing out said entrainment vessel outlet opening.

14. A system for treating crude oil to improve its flowability according to claim 13 including;

a controllable choke having an inlet end connected to said entrainment vessel outlet opening and an outlet end, the controllable choke providing variable area flow restriction through which gasified crude oil passes.

15. A system for treating crude oil to improve its flowability according to claim 12 including:

a gas separator having a gasified crude oil inlet, a treated crude oil outlet and an excess gas outlet and providing a quiescent zone therewithin to allow excess gas to escape from said gasified crude oil.

16. A system for treating crude oil to improve its flowability comprising:

a hydrocarbon fuel consuming apparatus having an exhaust from which exhaust gas emanates;

a cooler through which said exhaust flows by which the temperature thereof is reduced to provide cooled exhaust gas;

a separator having a cooled gas inlet, a dry gas outlet and a water outlet, the separator serving to extract at least a substantial portion of water contained in said cooled exhaust gas to provide dry exhaust gas;

a compressor connected to receive said dry exhaust gas and to raise the pressure there to provide pressurized exhaust gas;

a pump receiving crude oil therein and provide at a discharge opening pressurized crude oil;

a pressurized treating vessel having a pressurized crude oil inlet, a pressurized exhaust gas inlet and a gasified crude oil outlet and arranged to cause therein intimate mixing of said pressurized crude oil with said pressurized exhaust gas to provide gasified crude oil; and a separator having a gasified crude oil inlet, an excess gas outlet and a treated crude oil outlet and having a quiescent zone therein permitting excess gas to escape from said gasified crude oil to provide treated crude oil having improved flowability.

17. A system for treating crude oil to improve its flowability according to claim 16 including:

an entrainment vessel having an inlet opening and an outlet opening, the inlet opening being connected by a conduit with said treating vessel gasified crude oil outlet, the entrainment vessel having a flow path therethrough having a cross-sectional area greater than a flow path through said conduit whereby the velocity of flow of gasified crude oil is reduced as said crude oil passes through the entrainment vessel to thereby augment absorption of gas by said gasified crude oil passing therethrough, gasified crude oil having increased exhaust gas absorbed therein passing out said entrainment vessel outlet opening.

* * * * *